US005211234A

United States Patent [19]

Floyd

[11] Patent Number: 5,211,234

[45] Date of Patent: May 18, 1993

[54] HORIZONTAL WELL COMPLETION METHODS

[75] Inventor: L. Craig Floyd, Houston, Tex.

[73] Assignee: Halliburton Company, Duncan, Okla.

[21] Appl. No.: 828,076

[22] Filed: Jan. 30, 1992

[51] Int. Cl.[5] ..... E21B 33/14; E21B 43/12

[52] U.S. Cl. ..... 166/276; 166/50; 166/292; 166/295; 166/297

[58] Field of Search ..... 166/276, 281, 289, 292, 166/295, 297, 50

[56] References Cited

U.S. PATENT DOCUMENTS

| | | | |
|---|---|---|---|
| 2,248,028 | 7/1941 | Prutton | 166/295 |
| 3,708,013 | 1/1973 | Dismukes | 166/276 |
| 3,967,681 | 9/1975 | Curzon | 166/295 X |
| 4,682,652 | 7/1987 | Huang et al. | 166/50 X |
| 4,829,100 | 5/1989 | Murphey et al. | 523/131 |
| 4,917,188 | 4/1990 | Fitzpatrick, Jr. | 166/295 |
| 4,942,186 | 7/1990 | Murphey et al. | 523/131 |
| 5,058,676 | 10/1991 | Fitzpatrick et al. | 166/295 X |
| 5,095,987 | 3/1992 | Weaver et al. | 166/276 |
| 5,103,912 | 4/1992 | Flint | 166/297 |
| 5,121,795 | 6/1992 | Ewert et al. | 166/292 |
| 5,127,473 | 7/1992 | Harris et al. | 166/281 X |

*Primary Examiner*—George A. Suchfield

*Attorney, Agent, or Firm*—Thomas R. Weaver; David J. Alexander

[57] ABSTRACT

Methods of completing a well bore having a conduit disposed therein where portions of the well bore and conduit are positioned substantially horizontally in a subterranean producing formation are provided. A hardenable resin composition coated particulate solid material is placed in the annulus between the sides of the well bore and the conduit, and the resin composition is caused to harden whereby the particulate material is consolidated into a hard permeable mass. An aqueous cement slurry is introduced into the permeable consolidated particulate material whereby horizontal sections thereof are isolated which allows tests and/or treatments in selected portions of the horizontal well to be performed.

20 Claims, 2 Drawing Sheets

HORIZONTAL WELL COMPLETION METHODS

BACKGROUND OF THE INVENTION

1. Field of the Invention

The present invention relates generally to horizontal well completion methods, and more particularly, to improve methods for completing the portions of a well bore and conduit which are positioned substantially horizontally in a hydrocarbon containing subterranean formation.

2. Description of the Prior Art

Horizontal wells are those wells wherein at least the lower end portion of the well bore is positioned substantially horizontally in a hydrocarbon containing subterranean formation. The horizontal portions of such wells have been completed "open hole" when the material forming the subterranean formation permits and "cased hole" where the subterranean formation is partially or wholly incompetent. In heretofore cased hole completions, the casing has been cemented in the substantially horizontal portion of the well bore utilizing impermeable cement. In those completions, a large number of perforations are generally required in order to allow the hydrocarbons from the subterranean formation to readily flow through the impermeable cement and into the interior of the casing. Also, as a result of the large number of perforations, the migration of incompetent formation materials, i.e., sand, with the hydrocarbons by way of the perforations is often a problem.

Thus, there is a need for improved horizontal well cased hole completion methods whereby high fluid conductivity without sand migration is achieved.

SUMMARY OF THE INVENTION

The present invention provides methods of completing horizontal wells in subterranean producing formations which overcome the shortcomings of the prior art and meet the needs described above. In accordance with the present invention, at least the portions of a well bore and a conduit disposed therein, e.g., casing, which are positioned substantially horizontally in a producing formation are completed by first placing a hardenable resin composition coated particulate solid material in the annulus between the sides of the well bore and the conduit therein. The hardenable resin composition on the particulate material is then caused to harden which consolidates the particulate material into a hard permeable mass. Perforations are next formed in the conduit which are spaced along the horizontal length thereof and divide the conduit into two or more unperforated sections. An aqueous cement slurry is then introduced by way of the perforations into the permeable consolidated particulate material surrounding the conduit whereby sections thereof corresponding to the unperforated sections of the conduit are isolated from each other by portions of the cement slurry. The cement slurry is allowed to set into hard impermeable masses in the consolidated particulate material, and one or more of the unperforated sections of the conduit are perforated to allow the flow of hydrocarbons through the permeable consolidated particulate material into the interior of the conduit. The isolated sections of the permeable consolidated particulate material allow tests and treatments to be performed in selected portions of the producing formation along the length of the substantially horizontal well bore therein.

It is, therefore, a general object of the present invention to provide improved horizontal well completion methods.

A further object of the present invention is the provision of methods of completing a horizontal well whereby high horizontal hydrocarbon conductivity is provided without the concurrent migration of incompetent formation materials.

Other and further objects, features and advantages of the present invention will be readily apparent to those skilled in the art upon a reading of the description of preferred embodiments which follows.

DESCRIPTION OF PREFERRED EMBODIMENTS

Figure 1:
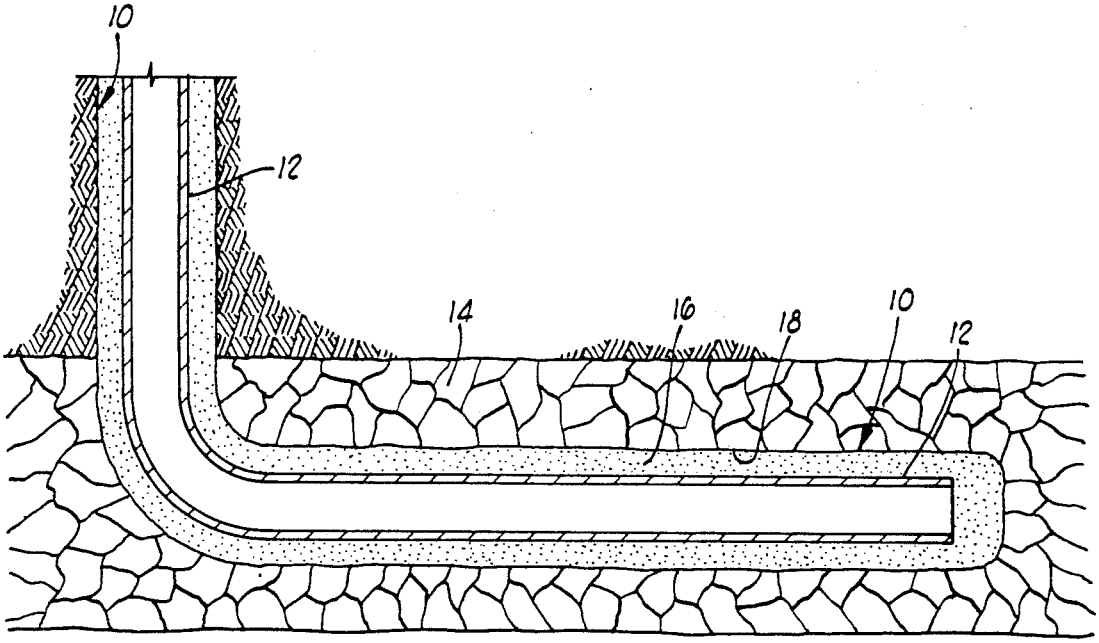
FIG. 1 is a schematic illustration of a well bore having a conduit disposed therein positioned substantially horizontally in a subterranean hydrocarbon containing formation after hardenable resin composition coated particulate solid material has been placed and consolidated between the sides of the well bore and the conduit.

The present invention provides improved methods of completing cased hole horizontal wells. In accordance with the methods, a well bore having a conduit disposed therein, e.g., casing, is completed whereby the portions of the well bore and conduit which are positioned substantially horizontally in a hydrocarbon producing formation are bonded together by a consolidated particulate solid material which is permeable to the flow of hydrocarbons. That is, the consolidated particulate solid material has a hydrocarbon fluid conductivity which approaches the fluid conductivity of the hydrocarbon producing formation. In addition, the permeable consolidated particulate solid material provides a barrier between perforations in the conduit and the face of the hydrocarbon producing formation which prevents the migration of sand and other incompetent materials from the formation into the conduit. Also, cement seals are provided in the permeable consolidated particulate material surrounding the conduit which are spaced along the length thereof whereby the consolidated particulate material is divided into isolated horizontal sections. The isolated sections can be separately perforated so that tests and/or treatments can be performed in selected portions of the formation through which the horizontal well bore extends.

The methods of completing a horizontal well bore as described above comprise the first step of placing a particulate solid material coated with a hardenable resin composition in the annulus between the sides of the substantially horizontal portion of the well bore and the conduit disposed therein. Once placed, the hardenable resin composition is caused to harden which consolidates the particulate material into a hard permeable mass and bonds the conduit to the well bore. A plurality of perforations are next formed in the portion of the conduit surrounded by the consolidated particulate material which are spaced along the length thereof whereby the perforations divide the conduit into two or more unperforated sections. An aqueous slurry of particulate cement having a high degree of fineness is then introduced into the permeable consolidated particulate material by way of the perforations whereby sections thereof corresponding to the unperforated sections of the conduit are isolated from each other by portions of the cement slurry. The cement slurry is allowed to set into hard impermeable masses in the consolidated particulate material. Finally, one or more of the isolated unperforated horizontal sections of the conduit are perforated in a manner whereby the permeable consolidated particulate material surrounding the conduit is left substantially intact and hydrocarbons without incompetent formation materials flow through the perforations into the conduit. As mentioned, since the permeable consolidated particulate material surrounding the conduit is sealed by the set portions of cement between the conduit sections, hydrocarbons from the subterranean formation adjacent one section can not flow by way of the permeable consolidated particulate material to the vicinities of the other sections. This allows the portion of the subterranean formation adjacent each isolated consolidated particulate material and conduit section to be tested or treated independently.

The hardenable resin composition coated particulate solid material utilized in accordance with this invention can be any of various types of particulate material coated with any of various hardenable resin compositions. The particulate material can be, for example, sand, sintered bauxite, glass particles, and the like. The preferred particulate material is sand having a particle size in the range of from about 10 to about 70 mesh, U.S. Sieve Series. The preferred particulate material size ranges are 10–20 mesh, 20–40 mesh, 40–60 mesh or 50–70 mesh depending upon the particle size and distribution of formation sand adjacent to which the resin coated sand is to be deposited. A preferred hardenable resin composition for coating the particulate material is comprised of a hardenable polyepoxide resin, at least one water immiscible diluent for the resin and a delayed hardening agent for the resin. Polyepoxide resins which can be utilized include the condensation products of epichlorohydrin and multiple hydroxy compounds such as resorcinol hydroquinone, glycerine, pentaerythritol, 1,4-butanediol, phloroglucinol, bisphenol A and bisphenol F. A particularly suitable and preferred such resin is the condensation resin product of epichlorohydrin and bisphenol A. A commercially available such product is marketed by the Shell Chemical Company of Houston, Tex. under the tradename EPON 828 ®. EPON 828 ® resin exhibits good temperature stability and chemical resistance, and has a viscosity of about 15,000 centipoises.

The one or more substantially water immiscible diluents are utilized in the resin composition to adjust the viscosity of the composition to a desired level, generally a level in the range of from about centipoises to about 800 centipoises. Preferably two polar organic diluents are used which are miscible with the polyepoxide resin and substantially immiscible with water. One of such diluents is preferably reactive with the epoxy resin component and the other diluent is preferably non-reactive.

The substantially water immiscible reactive diluent is preferably comprised of at least one member selected from the group consisting of butyl glycidyl ether, cresol glycidyl ether, allyl glycidyl ether, phenyl glycidyl ether, and other glycidyl ethers which are miscible with the epoxy resin utilized. Of these, butyl glycidyl ether and cresol glycidyl ether are the most preferred. The reactive diluent or diluents are generally present in the resin composition in an amount in the range of from about 2 to about 35 parts by weight per 100 parts by weight of the polyepoxy resin present. Preferably, the reactive diluent is present in the range of from about 15 to about 30, and most preferably, about 28 parts by weight per 100 parts by weight of polyepoxide resin.

Of the various water immiscible non-reactive diluents which can be utilized, one or more selected from the group of ethyl acetate, butyl lactate, ethyl lactate, amyl acetate, ethylene glycol diacetate and propylene glycol diacetate are preferred. Of these, butyl lactate is the most preferred. The water immiscible non-reactive diluent is generally included in the resin composition in an amount in the range of from about 4 to about 20 parts by weight per 100 parts by weight of the polyepoxide resin present. Preferably the nonreactive diluent is present in an amount in the range of from about 8 to about 15, and most preferably about 10 parts by weight per 100 parts by weight of the polyepoxide resin present. Examples of other diluents which can be utilized are methyl alcohol and other low molecular weight alkanols, tetrahydrofurfuryl methacrylate and ethyl acetate.

A variety of delayed hardening agents can be used in the resin composition. Examples of such hardening agents include amines, polyamines, amides and polyamides. A hardening agent which has been commonly utilized heretofore is methylene dianiline either dissolved in a suitable solvent such as ethyl acetate or in a liquid eutectic mixture of amines diluted with methyl alcohol. A preferred hardening agent is comprised of the adduct formed by reacting an aliphatic or cycloaliphatic amine with the condensation reaction product of epichlorohydrin and bisphenol A. While a variety of aliphatic amines can be utilized, preferred amines are those selected from the group consisting of ethylene diamine, triethylene tetramine, tetraethylene pentamine, bis-(p-aminocyclohexyl) methane, the diamines and triamines of cyclopentane and the diamines and triamines of cyclohexane. Of these, triethylene tetramine, 1,2-diaminocyclohexane and 1,4-diaminocyclohexane are preferred with 1,4-diaminocyclohexane being the most preferred. The adducts of the aliphatic amines are prepared by reacting a selected amine with the condensation reaction product of epichlorohydrin and bisphenol A.

The preferred hardening agent, i.e., the adduct formed by reacting an aliphatic amine with the condensation reaction product of epichlorohydrin and bisphenol A, is generally included in the resin composition in an amount in the range of from about 20 to about 150 parts by weight per 100 parts by weight of polyepoxy resin. Preferably, the hardening agent is present in an amount in the range of from about 40 to about 90, and most preferably, about 68 parts by weight per 100 parts of polyepoxide resin.

The hardenable resin composition can also include retarders or accelerators as hardening rate controllers to lengthen or shorten the working and cure times of the resin composition. Low molecular weight organic acid ester retarders such as alkyl esters of alkyl acids containing about 2 to 3 carbon atoms can be utilized. Suitable accelerators include 2,4,6-trisdimethylaminomethylphenol, the ethyl hexonate salt thereof and weak organic acid such as fumaric, erythorbic, ascorbic, salicylic and maleic acids. When a retarder or accelerator is utilized, it is generally combined with the resin composition in amounts up to about 10 parts by weight per 100 parts by weight of polyepoxide resin.

The resin composition also preferably includes a resin to particulate material coupling agent to promote bonding of the resin to the particulate material. A preferred such coupling agent is N-beta-(aminoethyl)-gamma-aminopropyltrimethoxysilane. The coupling agent generally can be included in the resin composition in an amount from about 0.1 to about 2 parts by weight per 100 parts by weight of polyepoxide resin.

The preparation of the hardenable resin composition coated particulate solid material and its placement in the well bore, i.e., in the annulus between the sides of the portion of the well bore which is positioned substantially horizontally and the conduit disposed therein, can be accomplished in various ways. For example, the resin coated particulate material can be prepared in a batch mixing operation followed by the suspension of the resin composition coated particulate material in a carrier liquid. The carrier liquid suspension of the resin coated particulate material can then be pumped within the conduit disposed in the well bore through the open end thereof and into the horizontal portion of the annulus between the well bore and the conduit. A more preferred technique for preparing and placing the resin composition coated particulate material is described in U.S. Pat. No. 4,829,100 issued May 9, 1989. In accordance with the technique disclosed therein, a consolidatable resin composition coated particulate material is continuously formed and suspended in a gelled aqueous carrier liquid, and the suspension is pumped to the zone where the resin coated particulate material is to be placed. As described in detail in the patent, substantially continuous streams of a gelled aqueous carrier liquid, uncoated particulate material, a resin composition which will subsequently harden and a surface active agent are admixed whereby the particulate material is continuously coated with resin composition and suspended in the gelled aqueous carrier liquid. The suspension is continuously pumped into the subterranean formation or other zone wherein the consolidatable resin composition coated particulate material is to be deposited.

The suspension of the hardenable resin composition coated particulate material in an aqueous gelled carrier liquid produced in accordance with U.S. Pat. No. 4,829,100 is comprised of an aqueous liquid, at least one hydratable polysaccharide gelling agent, the above described resin composition, particulate material and one or more surface active agents for promoting the coating of the particulate material with the resin composition. The aqueous liquid can be fresh water, brine or sea water. A variety of hydratable polysaccharide gelling agents can be utilized having molecular weights in the range of from about 100,000 to 4,000,000, preferably from about 600,000 to 2,400,000. Preferably, the polysaccharide gelling agents are cellulose or guar derivatives. The polymers include substituents such as hydroxyethyl to give the necessary water hydration and gel characteristics to produce a clear aqueous gel having a viscosity of at least about 30 centipoises (reading on a Fann V.G. meter at 300 rpm). Preferred such polymers include substituted carboxy and hydroxy alkyl cellulose, such as hydroxyethylcellulose and carboxymethylhydroxyethylcellulose, and substituted hydroxyalkylguar, such as hydroxypropylguar. The most preferred polysaccharide polymer gelling agent is hydroxypropylguar having a molecular weight in the range of from about 100,000 to about 4,000,000, and having a propylene oxide substitution (MS) of about 0.1 to about 0.7 moles of propylene oxide per mole of mannose and galactose in the guar.

The surface active agent for promoting the coating of the particulate material can be one or more cationic surface active agents or one or more non-cationic surface active agents, or one or more of both. As used herein, a noncationic surface active agent includes a blend of anionic and non-ionic surface active agents. Useful cationic surface active agents include the reaction product of an alcohol, epichlorohydrin and triethylenediamine wherein monohydric aliphatic alcohols having in the range of from about 12 to about 18 carbon atoms are reacted with from 2 to 3 moles of epichlorohydrin per mole of alcohol followed by reaction with an excess of triethylenediamine. The alcohol-epichlorohydrin reaction product contains an ethoxylation chain having pendent chlorides. The subsequent reaction with triethylenediamine provides a cationic and a tertiary amine functionality to the resulting product.

The non-cationic surfactants are preferably ethoxylated fatty acids produced by reacting fatty acids containing from about 12 to about 22 carbon atoms with from about 5 to about 20 moles of ethylene oxide per mole of acid, most preferably from about 12 to about 18 moles of ethylene oxide per mole of acid, to produce a mixture of various quantities of ethoxylated acids and unreacted acids.

When the gelling agent used is a cellulose derivative, one preferred surface active agent is a blend comprised of isopropyl alcohol, the cationic agent described above and the non-cationic agent described above wherein the weight ratio of cationic agent to non-cationic agent in the blend is in the range of from about 0.4 to 1, and preferably about 0.6 parts by weight cationic agent per 1 part by weight non-cationic agent and wherein the weight ratio of isopropyl alcohol to non-cationic age blend is about 1 part by weight alcohol per 1 part by weight non-cationic agent.

When the gelling agent used herein is a galactomannan gum, a preferred surface active agent is a blend comprised of alcohol, e.g., amyl alcohol, the cationic agent described above and the non-cationic agent described above wherein the weight ratio of cationic agent to non-cationic agent in the blend is in the range of 0 to 1, and preferably about 0.2 parts by weight cationic agent per 1 part by weight noncationic agent and wherein the weight ratio of alcohol to noncationic agent in the blend is about 1 part by weight alcohol per 1 part by weight non-cationic agent.

After being prepared, the above-described composition is comprised of resin composition coated particulate material suspended in a gelled aqueous liquid. The gelled aqueous liquid preferably contains the polysaccharide polymer utilized in an amount in the range of from about 20 to about 120 lbs of polymer per 1000 gallons of water, brine or sea water whereby the gelled aqueous liquid has a viscosity in the range of from about 10 centipoises to about 400 centipoises. Most preferably, the gelled aqueous carrier liquid includes from about 30 to about 80 lbs of gelling agent per 1000 gallons of water, brine or sea water, and has a viscosity of from about 15 to about 100 centipoises. As is well understood by those skilled in the art, the gelled aqueous liquid can be crosslinked to increase its viscosity and stability.

A gel breaker is included in the gelled aqueous liquid to cause it to revert to a relatively thin liquid at the time the resin coated particulate material reaches the location of its placement. While a variety of gel breakers which are well known in the art can be utilized, an oxidative type of breaker such as sodium persulfate is preferred. Such oxidative gel breakers are generally included in the composition in an amount in the range of from about 0.5 pounds to about 50 pounds per 1000 gallons of gelled aqueous carrier liquid, but the particular amount depends on the specific time period required between when the gel breaker is added and when the gel must be broken. Increases in the amount of gel breaker shorten such time period.

The aqueous cement slurry useful in accordance with the present invention is comprised of water and a fine particulate hydraulic cement which sets into a hard impermeable mass. The water can be fresh water, salt water, seawater or brine. In order for the particulate hydraulic cement to be capable of flowing into the consolidated particulate solid material it must be of a fine particle size. A preferred such fine particle size cement is one consisting of particles of cementitous material having diameters no larger than about 30 microns, preferably no larger than about 17 microns, and still more preferably no larger than about 11 microns. The distribution of the various sized particles within the cementitious material should be such that 90% of the particles have a diameter not greater than about 25 microns, preferably about 10 microns, and still more preferably about 7 microns; 50% have a diameter not greater than about 10 microns, preferably about 6 microns, and still more preferably about 4 microns; and 20% of the particles have a diameter not greater than about 5 microns, preferably about 3 microns and still more preferably about 2 microns.

The particle size of the hydraulic cement can be indirectly expressed in terms of the surface area per unit weight of a given sample of the cement. This value, sometimes referred to as Blaine Fineness, can be expressed in units of square centimeters per gram ($cm^2$/gram) and is an indication of the ability of a cement to chemically interact with water and other materials. The activity is believed to increase with increased Blaine Fineness. The Blaine Fineness of the hydraulic cement used in accordance with this invention should be no less than about 6000 $cm^2$/gram, preferably greater than about 7000 $cm^2$/gram, more preferably greater than about 10,000 $cm^2$/gram and most preferably greater than about 13,000 $cm^2$/gram.

Hydraulic cements having the fineness and particle size distribution described above are disclosed in various prior United States patents including U.S. Pat. No. 4,761,183 to Clark which discloses slag and mixtures of slag with Portland cement, and U.S. Pat. No. 4,160,674 to Sawyer which discloses Portland cement. The hydraulic cements can also include fine pozzolan cement and/or fine silica in addition to the slag and/or Portland cement. The cements which are preferred for use in accordance with this invention are Portland cement and combinations thereof with slag wherein the quantity of Portland cement included in a mixture of Portland cement and slag can be as low as 10%, but is preferably no less than about 40%, more preferably about 60% and still more preferably about 80%. The most preferred cement of the fineness and particle size distribution described above is Portland cement.

The aqueous cement slurries useful herein can be formulated utilizing ratios of the weight of water per unit weight of the cementitious material described above in the range of from about 0.5 to about 5.0, preferably from about 1.0 to about 1.75 and still more preferably from about 1.0 to about 1.5 pounds of water per pound of cementitious material.

The slurry densities of the fine, i.e., small particle size, cements of this invention are lower than cements having usual particle sizes because of the high water ratios required to wet all of the surface area of the fine cement. The compressive strengths however, of the set lower density slurries are satisfactory for the penetration cementing purposes contemplated herein, especially in view of the greater reactivity of the fine cements. The density of the aqueous cement slurry utilizing the fine cement described can range from about 9.4 to about 14.9.

Referring now to FIGS. 1 through 4 of the drawing, a horizontal well comprised of a well bore 10 having a conduit 12 disposed therein is schematically illustrated. The well bore 10 is positioned substantially vertically until it reaches a subterranean hydrocarbon producing formation 14 whereupon it turns at an angle of about 90° and extends substantially horizontally a distance in the formation 14. The term "substantially horizontally" as used herein when referring to the position of portions of a well bore and a conduit disposed therein in a subterranean formation means that such portions are positioned with respect to a vertical line extending there above at an angle in the range of from about 45° to about 135°.

A hardenable resin composition coated particulate solid material of the type described above which is consolidatable into a hard permeable mass is first placed in the annulus 16 between the sides of the well bore 18 and the conduit 12 as shown in FIG. 1. As indicated above, the consolidatable resin composition coated particulate material is preferably pumped through the conduit 12 as a suspension in an aqueous gelled carrier liquid and then into the annulus 16 whereupon the gelled aqueous carrier liquid reverts to a thin liquid and the consolidatable resin coated particulate material is deposited in the annulus 16. After placement, the resin composition coated particulate material is caused to consolidate into a hard permeable mass which bonds to the walls 18 of the subterranean formation 14 and to the external surfaces of the conduit 12. Generally, the resin composition coated particulate material is placed and consolidated in only the substantially horizontal portion of the annulus 16, and the usual primary cementing techniques using a hydraulic cement slurry is utilized for cementing the conduit 12 in the vertical portion of the well bore 10.

Figure 2:
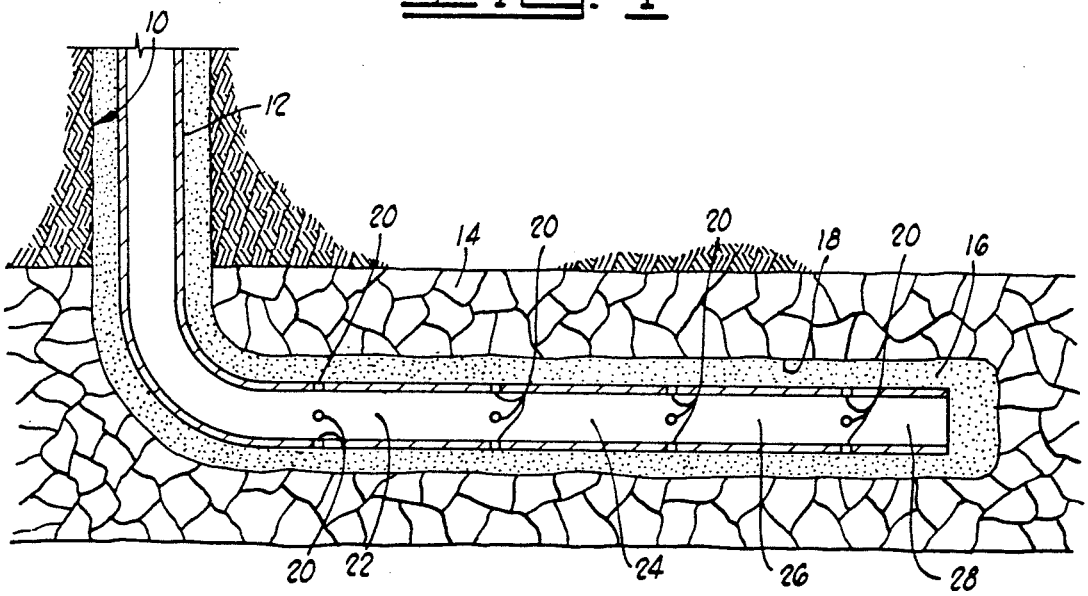
FIG. 2 is a schematic illustration of the well bore and conduit of FIG. 1 after perforations dividing the conduit into unperforated sections have been formed therein.

After the resin composition coated particulate material has been placed and consolidated in the substantially horizontal annulus 16, a plurality of perforations 20 are formed in the conduit 12 as shown in FIG. 2. The perforations 20 are spaced along the length of the portion of the conduit 12 which is positioned substantially horizontally whereby the perforations divide the conduit into at least two unperforated sections. In FIG. 2 the perforations 20 divide the conduit 12 into four unperforated conduit sections 22, 24, 26 and 28.

Figure 3:
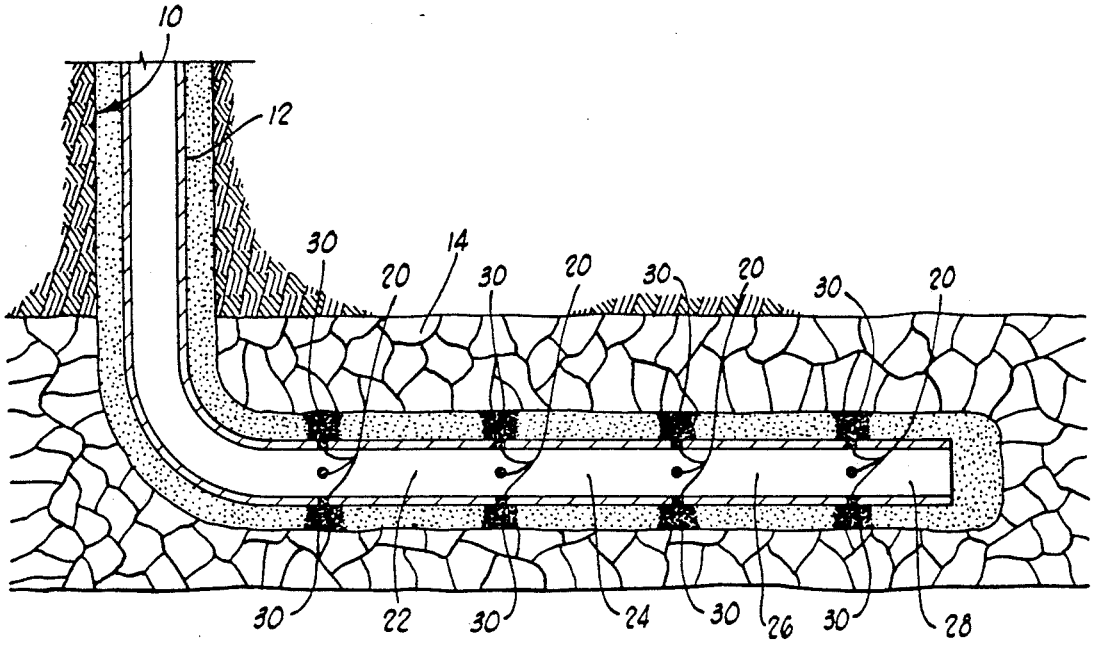
FIG. 3 is a schematic illustration of the well bore and conduit of FIG. 2 after an aqueous cement slurry has been introduced by way of the perforations into the permeable consolidated particulate material surrounding the conduit whereby sections thereof corresponding to the unperforated sections of the conduit are isolated from each other.

In accordance with the next step of the method of the present invention and as shown in FIG. 3, an aqueous cement slurry is introduced into the permeable consolidated particulate material surrounding the conduit 12 within the annulus 16 by way of the perforations 20 whereby sections of the consolidated particulate material corresponding to the unperforated sections 22, 24, 26 and 28 of the conduit 12 are isolated from each other by portions 30 of the cement slurry. That is, after the cement slurry portions 30 set into hard impermeable masses in the consolidated particulate material, hydrocarbons flowing into the consolidated particulate material from the formation 14 are prevented from flowing between adjacent sections of the consolidated particulate material.

Figure 4:
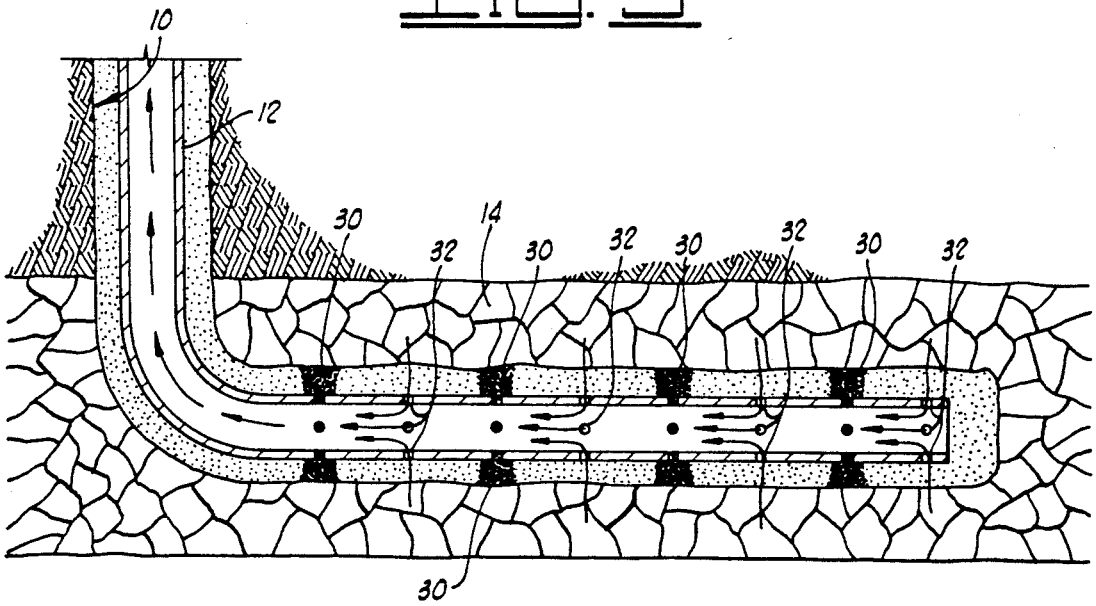
FIG. 4 is a schematic illustration of the well bore and conduit of FIG. 3 after perforations have been formed in each of the conduit sections and hydrocarbon production has been commenced.

The portions of the cement slurry 30 are allowed to set within the consolidated particulate material in the annulus 16 whereupon the unperforated sections 22, 24, 26 and 28 of the conduit 12 are perforated. As shown in FIG. 4, perforations 32 are formed in the conduit 12 whereby hydrocarbons from the portions of the formation 14 adjacent the conduit sections 22, 24, 26 and 28 flow into the conduit 12 by way of the perforations 32. As will be understood by those skilled in the art, the isolated sections of the consolidated particulate material surrounding the conduit 12 allow tests and treatments to be carried out in selected portions of the formation 14 penetrated by the well bore 10. For example, the perforations 32 can be formed separately in the conduit sections 22, 24, 26 and 28, and the hydrocarbon production from the portions of the formation adjacent each section determined. If one or more of the formation sections require stimulation, treatments can be effected in those sections without appreciably disturbing other formation sections.

The perforations 32 are formed in the conduit 12 whereby the permeable consolidated particulate material surrounding the conduit 12 is disturbed as little as possible. This can be accomplished by utilizing shallow penetration perforation techniques known to those skilled in the art or predrilled perforations with removable plugs therein can be used.

Thus, the present invention is well adapted to carry out the objects and attain the ends and advantages mentioned as well as those which are inherent therein. While numerous changes may be made to the invention by those skilled in the art, such changes are encompassed within the spirit of this invention as defined by the appended claims.

What is claimed is:

1. A method of completing a well bore having a conduit disposed therein where at least the lower end portions of the well bore and conduit are positioned substantially horizontally in a subterranean formation comprising the steps of:

(a) placing hardenable resin composition coated particulate solid material which is consolidatable into a hard permeable mass in the annulus between the sides of said substantially horizontally positioned portions of said well bore and said conduit;

(b) causing said hardenable resin composition to harden whereby said particulate material is consolidated into a hard permeable mass;

(c) forming perforations in said substantially horizontally positioned portion of said conduit which divide said conduit into two or more unperforated sections;

(d) introducing an aqueous cement slurry by way of said perforations into said permeable consolidated particulate material whereby sections thereof corresponding to said unperforated sections of said conduit are isolated from each other by portions of said cement slurry;

(e) allowing said portions of said cement slurry to set into hard impermeable masses in said consolidated particulate material; and (f) perforating one or more of said unperforated sections of said conduit.

2. The method of claim 1 wherein said resin composition is comprised of a hardenable polyepoxide resin, a water immiscible diluent for said resin and a hardening agent for said resin.

3. The method of claim 2 wherein said polyepoxide resin is comprised of the condensation product of epichlorohydrin and bisphenol A.

4. The method of claim 3 wherein said hardening agent is comprised of the adduct formed by reacting an aliphatic amine with the condensation reaction product of epichlorohydrin and bisphenol A.

5. The method of claim 4 wherein said diluent for said resin is comprised of a mixture of a reactive diluent and a non-reactive diluent.

6. A method of claim 5 wherein said reactive diluent is selected from the group consisting of butyl glycidyl ether, cresol glycidyl ether, allyl glycidyl ether and phenyl glycidyl ether.

7. The method of claim 6 wherein said non-reactive diluent is selected from the group consisting of ethyl acetate, butyl lactate, ethyl lactate, amyl acetate, ethylene glycol diacetate and propylene glycol diacetate.

8. The method of claim 1 wherein said hardenable resin composition coated particulate material is placed in said annulus by suspending it in an aqueous carrier liquid and pumping the resulting suspension into said annulus.

9. The method of claim 1 wherein said aqueous cement slurry is comprised of water and a hydraulic cement comprised of Portland cement, slag or a mixture thereof having a particle size no greater than 30 microns and a Blaine Fineness of no less than 6000 $cm^2/gm$.

10. The method of claim 9 wherein said cement is Portland cement and wherein 90% of the cement particles have a diameter no greater than 25 microns, 50% of the particles have a diameter no greater than 10 microns and 20% of the particles have a diameter no greater than 5 microns.

11. A method of completing a well bore having a conduit disposed therein where portions of the well bore and conduit are positioned substantially horizontally in a subterranean formation comprising the steps of:

(a) pumping an aqueous carrier liquid suspension of consolidatable resin composition coated particulate solid material into the annulus between the sides of said substantially horizontally positioned well bore and said conduit whereby said resin composition coated particulate material is deposited therein;

(b) causing said resin composition coated particulate material to consolidate into a hard permeable mass;

(c) forming perforations in said substantially horizontally positioned portion of said conduit which divide said conduit into two or more unperforated sections;

(d) pumping an aqueous cement slurry wherein the particles of the cement therein are of a size no greater than 30 microns and have a Blaine Fineness of no less than 6000 $cm^2/gm$ by way of said perforations into said permeable consolidated particulate material whereby sections thereof corresponding to said unperforated sections of said conduit are isolated from each other by portions of said cement slurry;

(e) allowing said portions of said cement slurry to set into hard impermeable masses in said consolidated particulate material; and (f) perforating one or more of said unperforated sections of said conduit.

12. The method of claim 11 wherein said resin composition is comprised of a hardenable polyepoxide resin, at least one water immiscible diluent for said resin and a hardening agent for said resin.

13. The method of claim 12 wherein said polyepoxide resin is comprised of the condensation product of epichlorohydrin and bisphenol A.

14. The method of claim 13 wherein said hardening agent is comprised of the adduct formed by reacting an aliphatic amine with the condensation reaction product of epichlorohydrin and bisphenol A.

15. The method of claim 14 wherein said diluent for said resin is comprised of a mixture of a reactive diluent and a non-reactive diluent.

16. The method of claim 15 wherein said reactive diluent is selected from the group consisting of butyl glycidyl ether and cresol glycidyl ether.

17. The method of claim 16 wherein said non-reactive diluent is butyl lactate.

18. The method of claim 17 wherein said cement is selected from the group consisting of Portland cement, slag and mixtures thereof.

19. The method of claim 18 wherein said cement is Portland cement and wherein 90% of the cement particles have a diameter no greater than 25 microns, 50% of the particles have a diameter no greater than 10 microns and 20% of the particles have a diameter no greater than 5 microns.

20. The method of claim 19 wherein said cement has a particle size no greater than about 17 microns and a Blaine Fineness greater than about 10,000.

* * * * *

UNITED STATES PATENT AND TRADEMARK OFFICE

CERTIFICATE OF CORRECTION

PATENT NO. : 5,211,234

DATED : May 18, 1993

INVENTOR(S) : L. Craig Floyd

It is certified that error appears in the above-identified patent and that said Letters Patent is hereby corrected as shown below:

In column 3, line 66, delete (centipoises) and insert therefore -- 100 centipoises --

In column 6, line 47, delete (age) and insert therefore -- agent in the --

Signed and Sealed this

Twenty-fifth Day of January, 1994

Bruce Lehman

*Attest:*

BRUCE LEHMAN

*Attesting Officer*

*Commissioner of Patents and Trademarks*